US007319833B1

(12) United States Patent
Miller

(10) Patent No.: US 7,319,833 B1
(45) Date of Patent: Jan. 15, 2008

(54) DEVELOPER ROLLER PRESERVER

(75) Inventor: Steven Miller, Pinellas Park, FL (US)

(73) Assignee: Cartridge Corporation of America, Inc., Clearwater, FL (US)

( * ) Notice: Subject to any disclaimer, the term of this patent is extended or adjusted under 35 U.S.C. 154(b) by 146 days.

(21) Appl. No.: 11/162,930

(22) Filed: Sep. 28, 2005

Related U.S. Application Data

(63) Continuation-in-part of application No. 10/742,323, filed on Dec. 19, 2003, now Pat. No. 7,136,608.

(51) Int. Cl.
*G03G 21/16* (2006.01)

(52) U.S. Cl. ..... 399/111

(58) Field of Classification Search ..... 399/25, 399/103, 111, 119
See application file for complete search history.

(56) References Cited

U.S. PATENT DOCUMENTS 5,089,853 A 2/1992 Uematsu
6,246,841 B1 6/2001 Merrifield et al.
6,771,922 B2 8/2004 Blanck et al.
2003/0185587 A1* 10/2003 Kawai et al. ..... 399/111
2005/0025522 A1* 2/2005 Tsuzuki et al. ..... 399/111

* cited by examiner

*Primary Examiner*—Sandra L. Brase
(74) *Attorney, Agent, or Firm*—Thomas E. Toner; Smith & Hopen, P.A.

(57) ABSTRACT

A toner cartridge adapted to fit within a toner cartridge-receiving cavity of a printer. The body of the cartridge comprises a front section, which houses the photoconductive drum common in all printers, capable of being biased in relation to the rest of the cartridge which houses the developer roller. The placement of a mechanical biasing element, or developer roller preserver, between the main body and front section creates a gap between the rigid photoconductive drum and the relatively soft developer roller. This gap prevents a "flat spot" from forming along the length of the developer roller during periods of long storage or non-use.

9 Claims, 6 Drawing Sheets

DEVELOPER ROLLER PRESERVER

CROSS REFERENCE TO RELATED APPLICATIONS

This application claims priority to U.S. patent application Ser. No. 10/742,323 entitled "Removable Toner Cartridge Universal Adapter," filed Dec. 19, 2003 now U.S. Pat. No. 7,136,608 and International Patent Application PCT/US 05/11,160 entitled "Integrated Toner Cartridge with Toner Agitator and Sensing Device," filed Apr. 1, 2005, the texts of which are fully incorporated herein by reference.

BACKGROUND OF THE INVENTION

The present invention relates to a toner cartridge adapted to fit within a toner cartridge-receiving cavity of a printer.

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the photoconductive transfer drum.

The photoconductive drum rotates opposite the developer roller, the developer roller being in fluid contact with the toner. The toner is transferred to paper, or other medium, as it passes over the rotating image transfer drum. Subsequently, the paper is heated so that the plastic is melted thereby permanently affixing the ink to the paper.

A particular failure of the devices of the prior art is the contact of the rigid photoconductive drum with the relatively soft developer roller. Given the toner cartridge may be in storage for long periods of time prior to sale or use, the contact between these two surfaces can result in a "flat spot" forming along the length of the relatively soft developer roller.

Therefore, what is needed is an efficient way of relieving the contact between the photoconductive drum and the developer roller during long periods of storage or non-use.

SUMMARY OF INVENTION

The long-standing but heretofore unfulfilled need for a toner cartridge that relieves the contact between the photoconductive drum and the developer roller during long periods of storage or non-use, and which also includes other improvements that overcome the limitations of prior art toner cartridges is now met by a new, useful, and non-obvious invention.

In one embodiment, the invention includes a toner cartridge adapted to fit within a toner cartridge-receiving cavity of a printer, comprising a developer roller and a photoconductive drum. The body of the toner cartridge is presented in two sections; a first section adapted to receive said developer roller, and a second section, in leading relation to said first section, adapted to receive said photoconductive drum. A developer roller preserver is removeably engageable with the toner cartridge between said first section and said second section at the axial ends of said developer roller for biasing said second section forward, in relation to said first section, establishing a space between said developer and said photoconductive drum.

In an illustrative embodiment, the front section is delineated at its trailing end by at least one slot, preferably two, formed in the side of the toner cartridge between the developer roller and photoconductive drum. The placing of the developer roller preserver in this slot forms a wedge, thereby biasing the front section away from the main body. This forms a gap between the developer roller and photoconductive drum.

In one embodiment, the developer roller preserver comprises a generally elongate U-shaped spacer bar with at least one, preferably two, wedge-shaped extension disposed at a distal end of said spacer bar.

Although a single spacer bar bearing wedge-tips at its ends is a preferable embodiment, other embodiments are also envisioned. For example, in place of a single developer roller preserver, a pair of disks with wedge-tips protruding from their center can be utilized wherein each disk engages the toner cartridge independently of the other. The invention also contemplates the use of any mechanism which places sufficient biasing force on the trailing end of the front section to create a gap between the developer roller and photoconductive drum.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
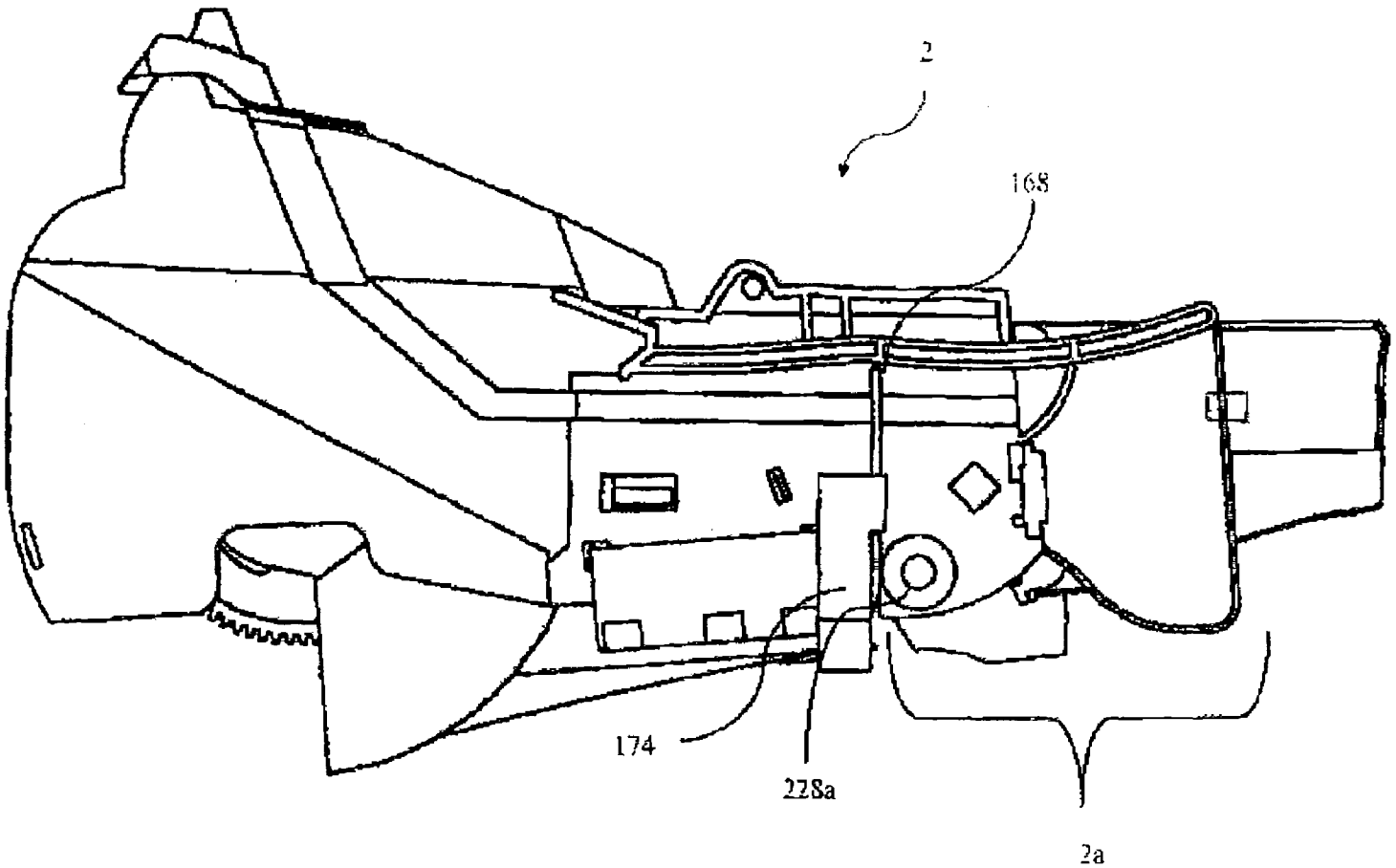
FIG. 1A is a perspective view of the non-drive side of the novel toner cartridge.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum 228 on which an electrostatic image is formed. Photoconductive drum rotates 228 in a plane perpendicular to that of the print medium passing through the toner cartridge. A recovery blade is placed in direct contact with the photoconductive drum. During the imaging stage, the photoconductive drum is exposed to light, usually a laser, which imprints a latent image thereon. Developer roller 296 converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

Construction of the Novel Toner Cartridge

Developer Roller Preserver

It will now be seen, referring to FIGS. 1-4, the novel toner cartridge of the instant invention includes developer roller preserver 174. Preserver 174 is generally U-shaped and has tapered wedge-tips 173 pointing inward at its distal ends. The body 2 of the novel toner cartridge comprises front section 2*a*, defined by slots 168 formed in the sidewalls of body 2. Slots 168 are formed in body 2 thus making the body sufficiently pliable to allow front section 2*a* (which houses photoconductive drum 228) to be pivotally displaced away from main body 2 (which houses developer roller 296). By placing tapered wedge-tips 173 within slots 168, front section 2*a* is biased forward thereby forming a gap between the photoconductive drum and the developer roller.

Figure 1B:
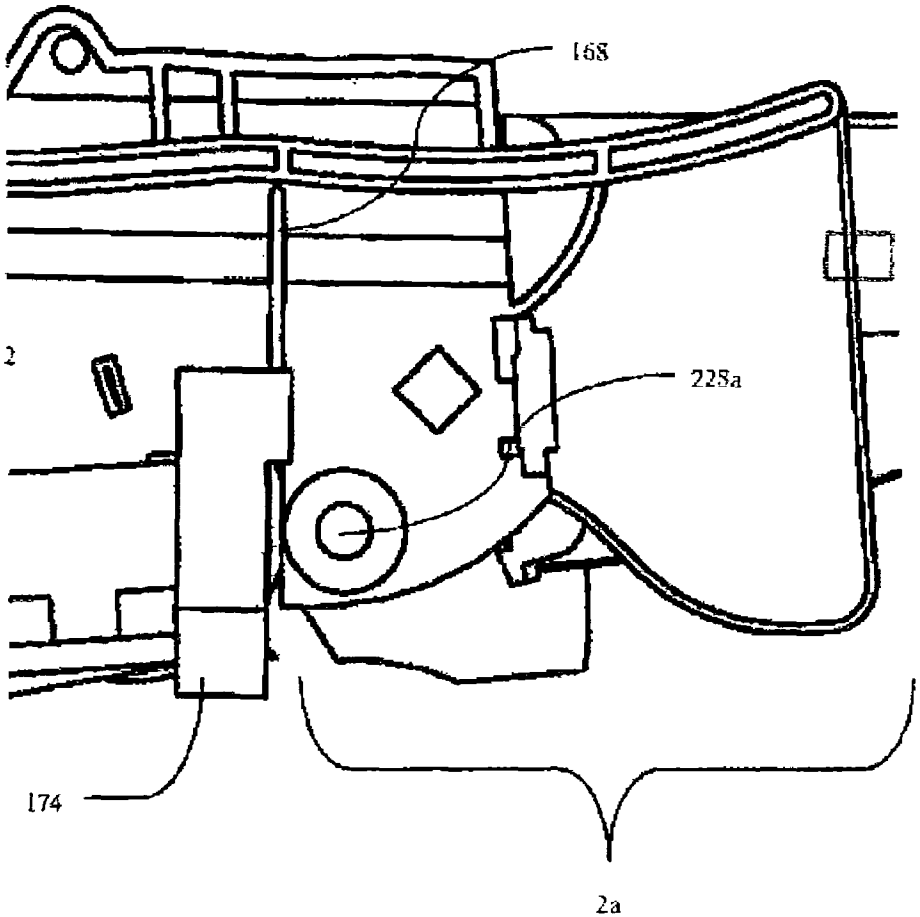
FIG. 1B is a closeup view of the non-drive side of the novel toner cartridge wherein the relationship of the main body, front section, and slot can be seen.

Turning now to FIG. 1A, showing the non-drive side of the novel toner cartridge, the relationship of main body 2 and front section 2*a* can be seen. Slots 168 are disposed in both sides of main body 2 and define the trailing end of front section 2*a*. Developer roller preserver 174 is shown in its position of engagement in trailing relation to photoconductive drum 228 (not shown) and in leading relation to developer roller 296. Receiving hole 228*a* accepts the shaft of photoconductive drum 228 (not shown). FIG. 1B shows a close-up view of how slot 168 defines the area of engagement between main body 2 and fronts section 2*a*.

Figure 2A:
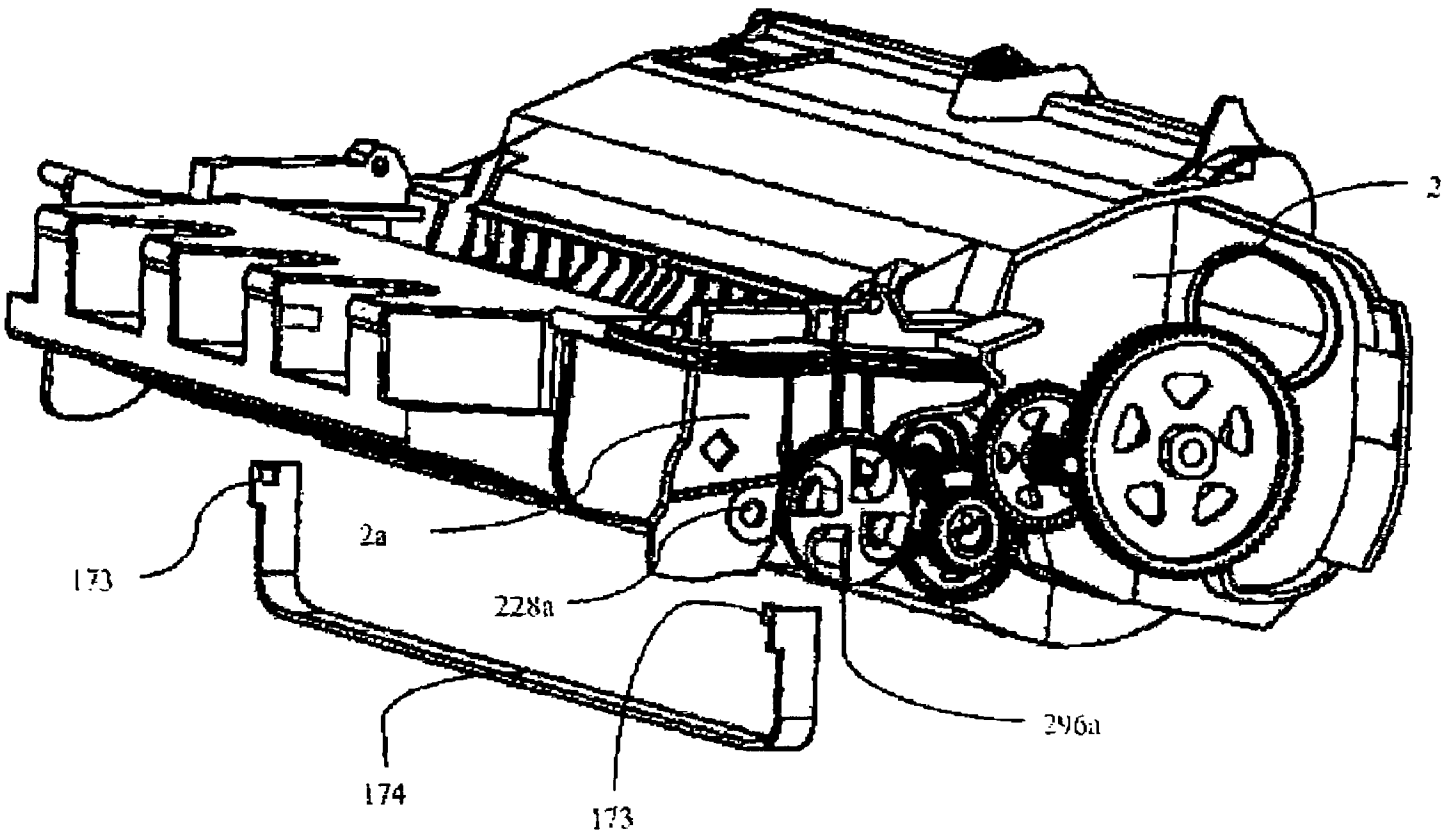
FIG. 2A is a front-left perspective view of the drive-side of the novel toner cartridge showing the developer roller preserver prior to engagement with the slots.

FIG. 2A presents a perspective view of the drive-side of the novel toner cartridge. In this view the photoconductive drum is removed. From this angle it can be seen how the wedge-tips 173 of the developer roller preserver 174 engage slots 168 thereby biasing front section 2*a* forward. When installed, wedge-tips 173 engage holes 167 formed in slots 168 and become locked against further movement until removed. Holes 167 prevent the resilient characteristics of the toner cartridge from forcing developer roller preserver 174 from slots 168.

Figure 2B:
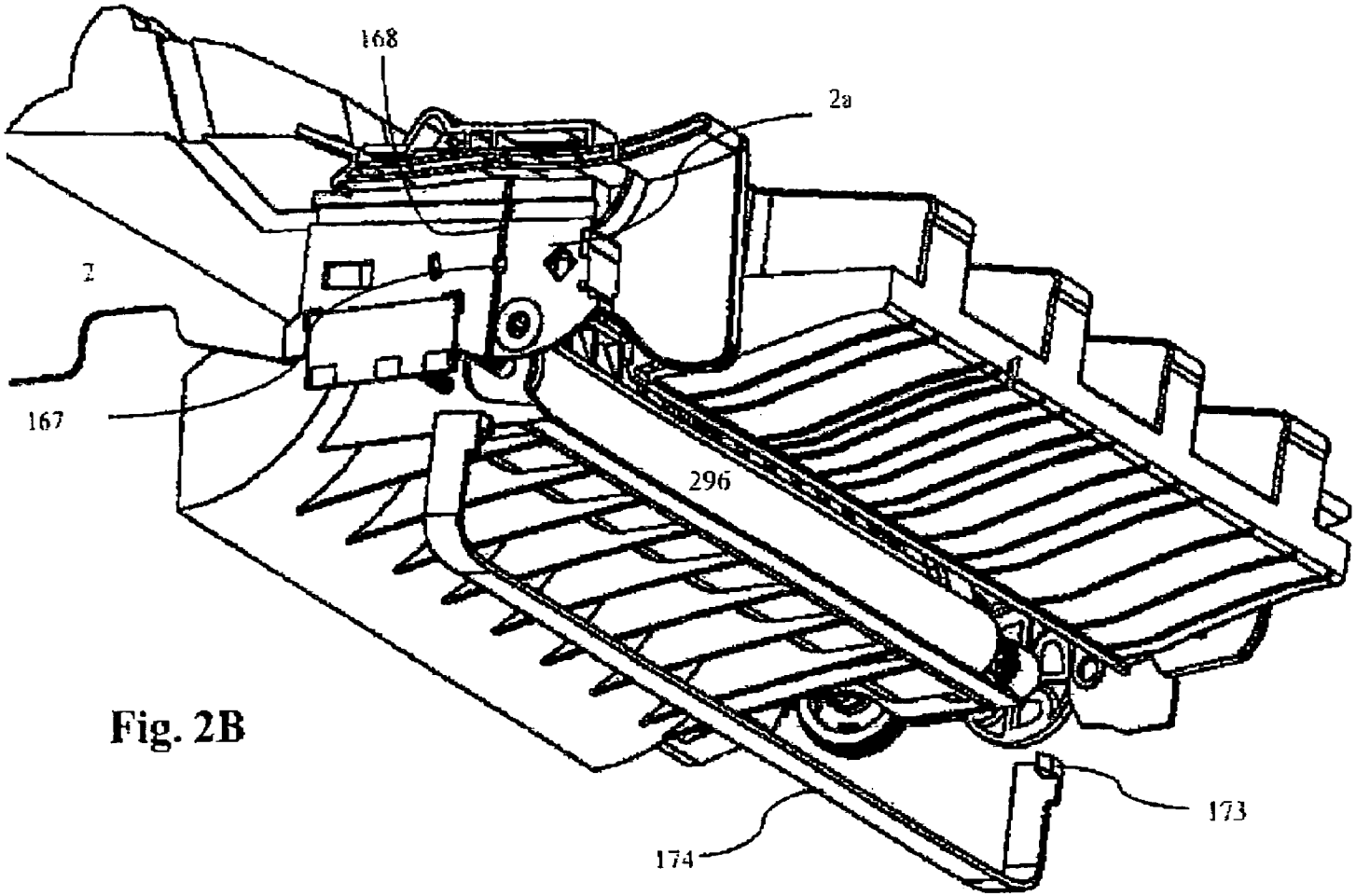
FIG. 2B is a lower-right perspective view of the non-drive-side of the novel toner cartridge showing the developer roller preserver prior to engagement with the slots.

FIG. 2B represents a lower perspective view of the novel toner cartridge, again with the photoconductive drum removed. With the photoconductive drum removed the entire length of developer roller 296 is visible. Wedge-tips 173 are sufficiently greater in size than slots 168 and holes 167 to maintain a biasing force against front section 2*a*, and thereby photoconductive drum 228.

Figure 3:
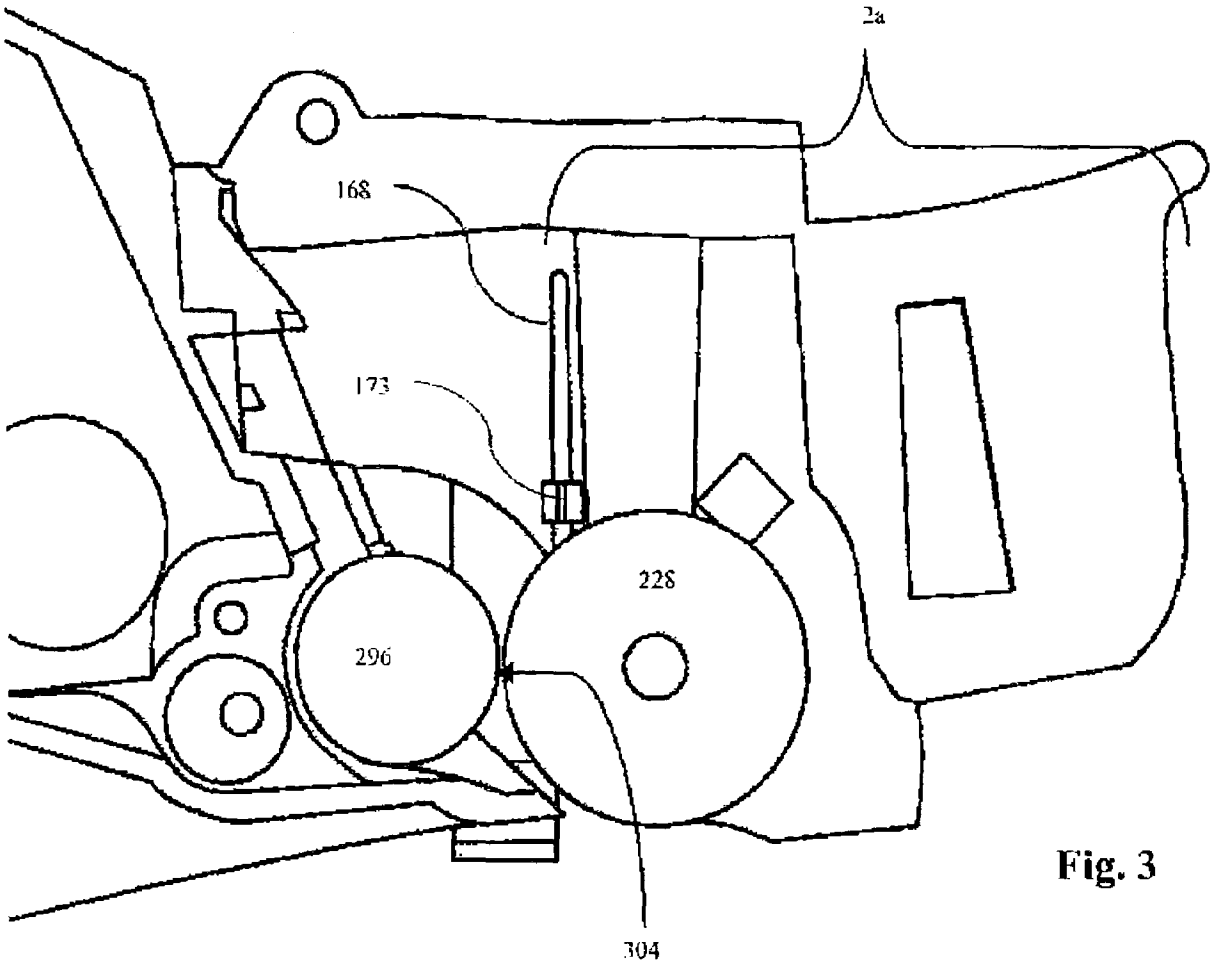
FIG. 3 is a cross section of the novel toner cartridge as viewed from the non-drive-side.
Figure 4:
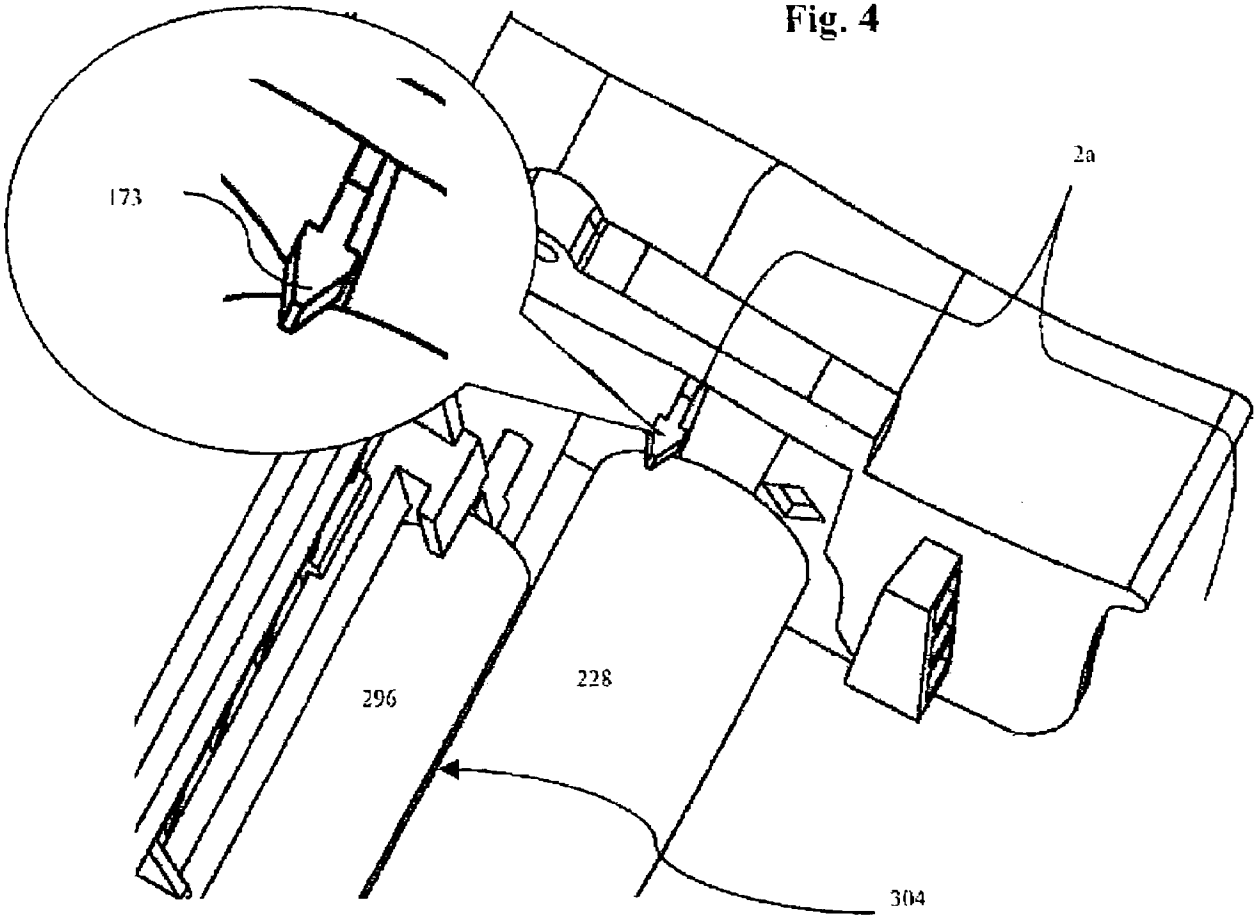
FIG. 4 is an elevated perspective of the wedge-tips of the developer roller preserver creating the gap between the photoconductive drum and the developer roller.

FIG. 3 is a cross section of the novel toner cartridge as seen with the non-drive side removed. Here the relationship of photoconductive drum 228 and developer roller 296 can be seen with the wedge-tip 173 of developer roller preserver 174 engaged in hole 167 of slot 168. With front section 2*a* biased forward by the presence of the wedge-tips 173, gap 304 is formed between photoconductive drum 228 and developer roller 296. In this manner, the relatively soft material of developer roller 296 will not form a "flat spot" where it engages the photoconductive drum. The same relationship of parts is shown from an elevated perspective in FIG. 4.

As discussed above, the presence of the gap between the developer roller and photoconductive drum prevents a "flat spot" from forming along the length of the developer roller during long periods of storage. This gap also has the advantage of preventing toner from collecting between developer roller 296 and photoconductive drum 228 and adhering to the respective parts, clogging the space there between. When the toner cartridge is ready for use, the user simply removes developer roller preserver 174 at which time the inherent rigidity of the toner cartridge returns front section 2*a* from its position of bias, at which time developer roller 296 and photoconductive drum 228 abut in their respective positions of operability. In the event that the cartridge is removed from the printer before it has been expended, the developer roller preserver can be re-installed until such time as the cartridge is to be used again.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described.

What is claimed is:

1. A toner cartridge adapted to fit within a toner cartridge-receiving cavity of a printer, comprising:

a developer roller;

a photoconductive drum;

a first section adapted to receive said developer roller;

a second section, adapted to receive said photoconductive drum, in leading relation to said first section; and a developer roller preserver removeably engageable with said toner cartridge between said first section and said second section at the axial ends of said developer roller for biasing said second section forward, in relation to said first section, establishing a space between said developer and said photoconductive drum.

2. The toner cartridge of claim 1 further comprising at least one slot, formed in a side of said cartridge, defining a space between said first and said second sections.

3. The toner cartridge of claim 2 where the developer roller preserver comprises:

a spacer bar;

at least one wedge-shaped extension disposed at a distal end of said spacer bar.

4. The toner cartridge of claim 3 wherein engagement of the wedge-shaped extension into the slot causes the second section of said toner cartridge to be displace forward, in relation to said first section.

5. The toner cartridge of claim 3 further comprising a widened area in said slot for removeably receiving said wedge-shaped extension.

6. A toner cartridge adapted to fit within a toner cartridge-receiving cavity of a printer, comprising:

a developer roller;

a photo conductive drum;

a first section adapted to receive said developer roller;

a second section, adapted to receive said photoconductive drum, in leading relation to said first section;

at least one slot, formed in the side of said cartridge, defining a space between said first and said second sections; and a spacer element for establishing a space between said developer and said photoconductive drum removeably engageable with said toner cartridge between said first section and said second section at the axial ends of said developer roller.

7. The toner cartridge of claim 6 where the spacer element comprises:

a spacer bar;

at least one wedge-shaped extension disposed at a distal end of said spacer bar.

8. The toner cartridge of claim 7 wherein engagement of the wedge-shaped extension into the slot causes the second section of said toner cartridge to be displace forward, in relation to said first section.

9. The toner cartridge of claim 6 further comprising a widened area in said slot for removeably receiving said wedge-shaped extension.

* * * * *